US005622453A

United States Patent [19]

Finley et al.

[11] Patent Number: 5,622,453

[45] Date of Patent: Apr. 22, 1997

[54] METHOD AND APPARATUS FOR IN-DENSIFICATION OF GEOMATERIALS FOR SEALING APPLICATIONS

[75] Inventors: Ray E. Finley; David H. Zeuch, both of Albuquerque, N.M.

[73] Assignee: The United States of America as represented by the United States Department of Energy, Washington, D.C.

[21] Appl. No.: 430,043

[22] Filed: Apr. 27, 1995

[51] Int. Cl.[6] ..... E21B 33/16; E02D 5/46

[52] U.S. Cl. ..... 405/240; 166/285; 166/292; 405/271

[58] Field of Search ..... 405/233, 240, 405/241, 271; 166/286, 288, 292, 285, 287; 588/250

[56] References Cited

U.S. PATENT DOCUMENTS

| | | | |
|---|---|---|---|
| 347,232 | 8/1886 | Dougan | 241/118 |
| 1,281,646 | 10/1918 | Park | 241/120 |
| 1,404,112 | 1/1922 | Geobl et al. | 405/258 |
| 3,232,670 | 2/1966 | Robbins et al. | 299/56 |
| 3,786,639 | 1/1974 | Pineno et al. | 405/267 |
| 3,817,039 | 6/1974 | Stewart et al. | 405/263 |
| 4,044,563 | 8/1977 | Hurst et al. | 405/267 |
| 4,126,007 | 11/1978 | Mars | 405/271 |
| 4,330,155 | 5/1982 | Richardson et al. | 299/11 |
| 4,397,588 | 8/1983 | Goughnour | 405/233 X |
| 4,400,314 | 8/1983 | Ellis et al. | 252/633 |
| 4,429,746 | 2/1984 | Allard | 166/291 |
| 4,557,632 | 12/1985 | Penny | 405/267 |
| 4,942,929 | 7/1990 | Malachosky et al. | 175/66 |
| 4,968,187 | 11/1990 | Burnett | 405/269 |
| 5,109,933 | 5/1992 | Jackson | 175/66 |
| 5,129,469 | 7/1992 | Jackson | 175/66 |
| 5,276,253 | 1/1994 | Circeo, Jr. et al. | 588/253 |
| 5,279,502 | 1/1994 | Goughnour | 405/233 X |

FOREIGN PATENT DOCUMENTS

| | | | |
|---|---|---|---|
| 614166 | 7/1978 | U.S.S.R. | 405/240 |

OTHER PUBLICATIONS

Finley et al., 1994 "Sealing of Boreholed Using Natural, Compatible Materials: Granular Salt," Proceedings of Eurock '94, Joint Society of Petroleum Engineers/International Society for Rock Mechanics International Conference held at Delft, the Netherlands, 29–31 Aug. 1994, pp. 753–760.

Lambert et al., 1992 "Interactions Between Concrete and Brine at the Waste Isolation Pilot Plant (WIPP) Site, New Mexico," Materials Research Society Symposium Proceedings vol. 245, pp. 111–116.

Finley et al., 1992 "WIPP Small Seal Performance Tests—Status and Impacts," Sandia Report SAND91–2247, UC–721.

Pusch et al., 1990 "Borehole, Shaft and Tunnel Sealing of Rock Repositories," Proceedings of the 3rd Nuclear Energy Agency/Swedish Nuclear Fuel and Waste Management Co. (EA/SKB) Symposium on the International Stripa Project, In Situ Experiments on the Disposal of Radioactive Waste, pp. 265–273.

Wawersik et al., 1986 "Modeling and Mechanistic Interpretation of Creep of Rock Salt Below 200° C.," Techtonophysics, 121, pp. 125–152.

*Primary Examiner*—David J. Bagnell

*Attorney, Agent, or Firm*—Russell D. Elliott; James H. Chafin; William R. Moser

[57] ABSTRACT

A method and apparatus (10) for forming improved seals in boreholes (101) formed in host rock (100) by using the apparatus (10) to introduce a feedstock (60) into the borehole (101) and simultaneously subject the introduced feedstock to both compressive and shear stresses until the borehole becomes filled and sealed.

15 Claims, 2 Drawing Sheets

METHOD AND APPARATUS FOR IN-DENSIFICATION OF GEOMATERIALS FOR SEALING APPLICATIONS

The United States Government has rights in this invention pursuant to Contract No. DE-AC04-76DP00789 between the U.S. Department of Energy and American Telephone and Telegraph Company.

TECHNICAL FIELD

This present invention relates to the field of sealing boreholes in general, and in particular, to a method and apparatus for the emplacement and densification of geomaterials within a borehole.

BACKGROUND ART

As can be seen by reference to the following U.S. Pat. Nos. 5,276,253; 4,942,929; 4,968,187; and 5,109,933; the prior art is replete with myriad and diverse methods and apparatus for backfilling boreholes, circular shafts, and the like.

While all of the aforementioned prior art constructions are more than adequate for the basic purpose and function for which they have been specifically designed, none of these prior art methods employ the simultaneous introduction of feedstock in conjunction with the application of compressive and shear stresses to the deposited feedstock resulting in a high quality seal that will satisfy rigorous EPA, NRC, and other agency regulations for compliance.

A major concern in sealing technology is the compliance of such seals to strict environmental regulations. Uncertainty in performance assessments of sealing components will be minimized by producing a higher quality seal at the outset. Current technology for emplacement of these materials depends on the application. For boreholes, grout or concrete is pumped to the desired seal location, bentonite or crushed rock and bentonite are pneumatically or hydraulically transported to the desired seal location, and crushed salt is essentially poured into the holes. For shaft applications, concrete is poured at the seal location. Bentonite and crushed salt would be emplaced in compressed blocks or tamped in place using standard hand-held civil construction cold-tamping equipment in shafts.

A deficiency in the current emplacement techniques for seals lies in the poor control of the in situ emplacement density for crushed salt and bentonite/rock seals and questions of chemical compatibility, longevity, and interface characteristics for grout and concrete seals.

Seals are typically used to reduce or control the flow of fluids from the region in which they are stored to the accessible environment. Crushed salt seals for example, are effective only after the crushed salt seal has achieved about 95% relative density to the intact rock.

Current technology for emplacing the crushed salt can only achieve about 80–85% relative density immediately upon emplacement. The crushed salt will, however, reconsolidate due to creep closure of the surrounding rock. This creep closure is expected to produce 95% relative density after about 100 years. Short-term components such as concrete and bentonite are used to provide temporary sealing for a limited time period while the salt seal matures. Certain scenarios suggest that the reconsolidation may be slowed or stopped if the crushed salt becomes saturated prior to complete reconsolidation.

Clearly then, a technique that allows emplacement of seals at relative densities above 85%, perhaps as high as 90–95%, would greatly reduce the uncertainty associated with the long-term sealing of hazardous or radioactive materials, or other storage scenarios.

As a consequence of the foregoing situation, there has existed a longstanding need for a new technology that will produce improved borehole seals having lower permeability, greater seal and interface strength, effective quality control, and enhanced chemical compatibility immediately upon emplacement; and, the provision of such a method and apparatus is a stated objective of the present invention.

DISCLOSURE OF THE INVENTION

Briefly stated, the equipment and technology that will be described in this application provides a solution to the problem of creating effective seals in boreholes and other penetrations in geologic materials. These seals are primarily intended to restrict the movement of radioactive or hazardous materials into the accessible environment. The seals must therefore, minimize uncertainties in performance such as seal strength, bond strength, permeability, and satisfy rigorous EPA, NRC, etc., regulations for compliance.

As will be explained in greater detail further on in the specification, the focus of this invention is to create a seal of any length desired in vertical boreholes or circular shafts by providing feedstock, such as crushed material compatible with the surrounding host rock, to the bottom of the hole and applying compressive and shear stresses using a bottom-hole device similar to a drill bit. Heat and moisture can be added to the feedstock to aid in the compaction process.

The rolling action of the cylindrical or cone rollers at the base of the borehole compaction tool provide both compressive and shear stresses on the crushed feedstock supplied through the drill string. The rollers may be spring loaded to maintain constant force to the roller surface. Heat and moisture can be supplied to the feedstock via hot-moist-air through the drill string. The entire process could be load, torque, and feed controlled so that the entire assembly lifts out of the hole as the seal is created.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
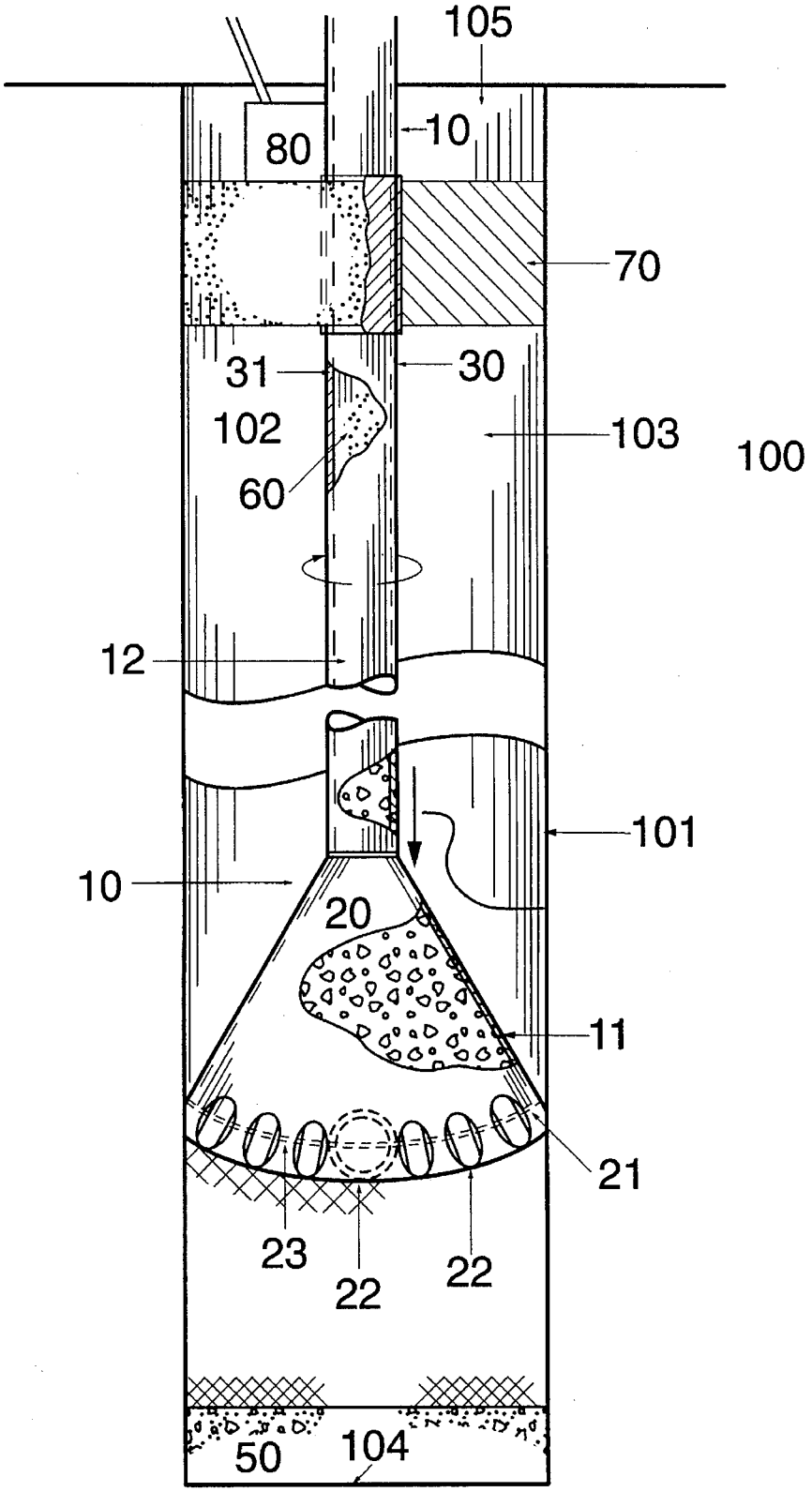
FIG. 1 is a cross-sectional view taken through a borehole containing the typical apparatus that will be employed to practice the teachings of this invention.

As can be seen by reference to the drawings, and in particular to FIG. 1, the sealing apparatus that is employed to practice the method that forms the basis of the present invention is designated generally by the reference numeral (10). The sealing apparatus (10) comprises in general, a compaction unit (11) and a drill string unit (12). These units will now be described in seriatim fashion.

Prior to embarking on a description of the apparatus (10) it would first be advisable to describe in general, the environment in which the apparatus (10) will be employed to practice the method of this invention. As shown in FIG. 1, a borehole (101) has been formed in the surrounding host rock (100) wherein the walls (102) of the borehole (101) define a generally cylindrical cavity (103) having a closed bottom end (104) and an open upper end (105).

Still referring to FIG. 1, it can be seen that the compaction unit (11) comprises a generally hollow conical tool member (20) provided with a generally convex compaction head member (21) provided with a plurality of roller elements (22) and a plurality of elongated apertures (23) whose purpose and function will be described presently.

As can also be seen by reference to FIG. 1, the drill string unit (12) comprises an elongated hollow drill string member (30), including a plurality of hollow drill string segments (31) operatively secured to one another; wherein, the lower end of the drill string member (30) is operatively connected to the upper end of the tool member (20); and, wherein the upper end of the drill string member (30) is connected to a conventional rotary power unit (not shown) for imparting both rotary and vertical movement to the compaction head member (21) in a well-recognized fashion.

Figure 2:
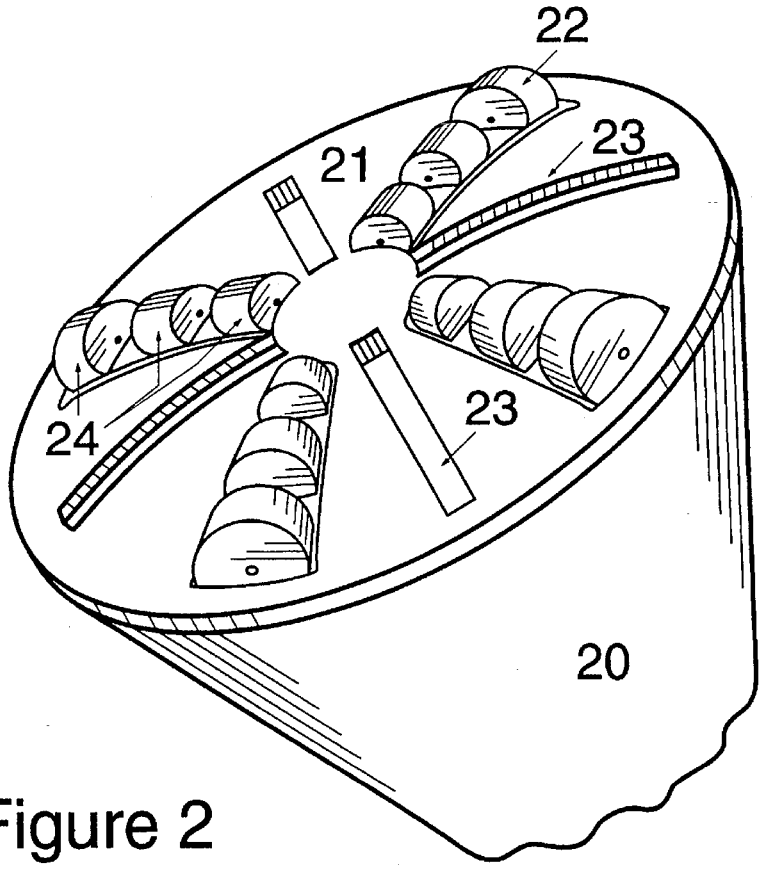
FIG. 2 is a perspective view of one version of the rotating tool head that will be employed in this invention.
Figure 3:
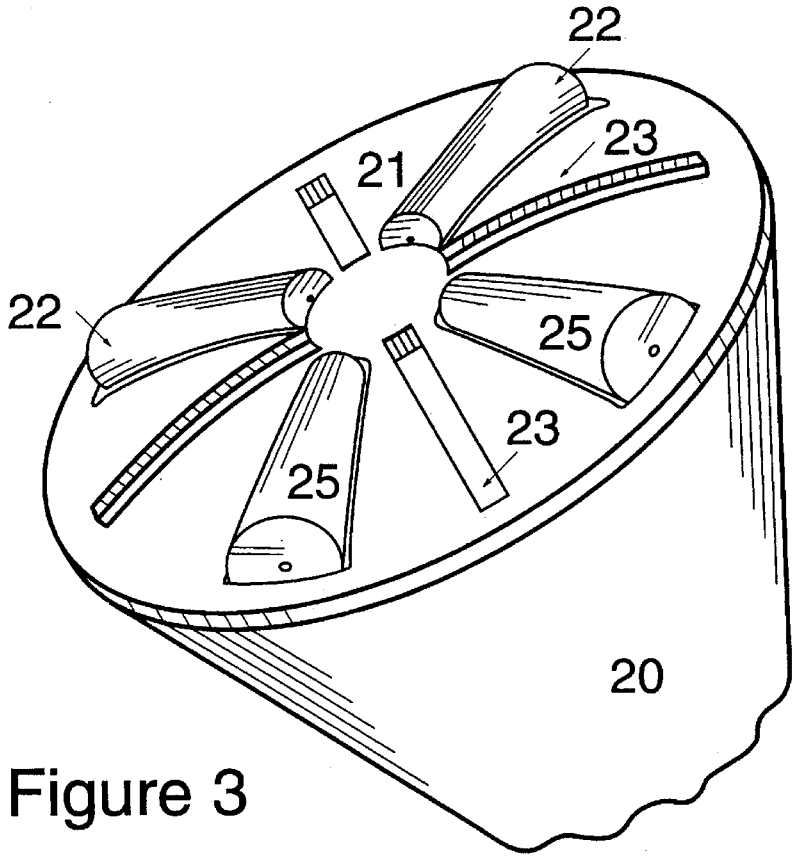
FIG. 3 is a perspective view of another version of the rotating tool head that will be employed in this invention.

Turning now to FIGS. 2 and 3, it can be seen that in both versions of the preferred embodiment, the plurality of elongated apertures (23) are radially aligned relative to the compaction head member (21) and the plurality of roller elements (22) are likewise radially aligned relative to the compaction head member (21) and disposed intermediate to the elongated apertures (23).

In addition, in the first version of the preferred embodiment illustrated in FIG. 2, each of the roller elements (22) comprise a plurality of axially aligned cylindrical rollers (24) having diameters which diminish in relation to their proximity to the center of the compaction head member (21).

Turning now to FIG. 3, it can be seen that in the second version of the preferred embodiment, each of the roller elements (22) comprise an elongated conical roller (25); and in both versions, the roller elements (22) rotate in a plane that is orthogonal to the plane of the compaction unit rotation.

As can best be appreciated by reference to FIG. 1, the method that is employed with the sealing apparatus (10) to practice the teachings of this invention, will now be described in seriatim fashion. First of all, a quantity of uncured concrete is deposited below the preferred sealing location (104) in the borehole (101) to form a concrete base (50). After the concrete base (50) has cured, the apparatus (10) is inserted into the borehole (101) and feedstock (60) is introduced through the drill string unit (12) to the compacting unit (11); whereupon, the feedstock (60) flows through the apertures (23) in the compaction head member (21) and the rollers (22) are rotated relative to the delivered feedstock to apply compressive and shear stresses to the feedstock material.

Roller-type compaction is commonly employed in civil construction, earth-work projects to densify both cohesive and cohesionless soils. The combination of shearing action of the rollers and compressive stresses from the assembly serve to crush and align the soil particles, thus decreasing the void space. The final soil density can be engineered by carefully controlling the thickness of compacted layers (lifts), the water content, and the weight, nature, and duration of the rolling compaction. The relative influence of the shearing is limited to the near surface while deeper layers continue to experience compressive loading.

Roller compaction is also employed in processing of potash and other minerals. Mineral processing compaction employs higher temperatures and higher stresses than those currently employed in civil construction.

The concept described herein would take advantage of the particle crushing that would occur at the roller interface and the compressive stresses within the seal below. The addition of temperature and minimal moisture will enhance crystal dissolution and recrystallization in the compaction of halite and potash. The technology has the distinct advantage of continuous compaction by carefully controlling the rate of feedstock supplied and the rate and nature of compaction tool rotation.

Additionally, heat will accelerate the creep of the surrounding host rock thereby enhancing the seal-borehole interface. This will also decrease the borehole DRZ (Disturbed Rock Zone), or region of elevated permeability surrounding underground openings and shorten the time required to achieve such characteristics as density, permeability, and mechanical properties similar to the original host rock.

The methodology described in this invention is quite different from existing technology in that the seals produced will be more effective with respect to lower permeability, greater seal and interface strength, better quality control, and fewer uncertainties about chemical compatibility immediately after emplacement.

The emplacement of high density crushed salt or potash seals eliminates questions about longevity or chemical compatibility of concrete components emplaced in salt or potash formations. In addition, the high density in situ emplacement of these materials using the technology described in this specification will result in seals whose performance can be technically defended in both the regulatory and licensing environment.

In those instances, wherein water and heat are to be added to the feedstock (60), the drill string (30) can further be provided with a borehole packer (70) to minimize extraneous water being introduced into the borehole (101) while an optional pump (80) will provide a regulated supply of water/steam to the feedstock mixture (60).

The proposed usage of elevated temperatures in this invention will aid greatly in the reconsolidation process for halite or potash. Experimental data on halite shows that creep rates increase exponentially with temperature increases.

Furthermore, employing bentonite and crushed rock seals will result in higher quality seals than those resulting from existing technology. It is known that the performance of these seals (i.e., seal strength, bond strength, permeability) is strongly dependent on the emplaced density. Current technology does not allow close control over the emplaced density, especially in boreholes where human access is limited.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

We claim:

1. A sealing apparatus for creating improved seals for boreholes and other generally cylindrical shafts formed in host rock wherein the sealing apparatus comprises:

a compaction unit, including a hollow tool member provided with a compaction head member dimensioned to be received in a borehole and having at least one elongated radially aligned aperture; and an elongated hollow drill string unit operatively attached on the lower end to said hollow tool member and provided on the upper end with first means to deliver feedstock to the compaction member and through said at least one elongated radially aligned aperture into the borehole, and second means to provide rotary and compressive movement to said compaction head member.

2. The sealing apparatus as in claim 1; wherein, said compaction head member is further provided with at least one radially aligned roller element.

3. The sealing apparatus as in claim 2; wherein, said compaction head member is provided with a plurality of radially aligned apertures.

4. The sealing apparatus as in claim 3; wherein, said compaction head member is provided with a plurality of radially aligned roller elements and said roller elements and apertures are arranged around said compaction head member in alternating fashion.

5. The sealing apparatus as in claim 4; wherein, said compaction head member has a generally convex surface.

6. The sealing apparatus as in claim 5; wherein, said plurality of roller elements rotate in a plane that is orthogonal to the plane of rotation of the compaction head member.

7. The sealing apparatus as in claim 4; wherein, each of said plurality of roller elements comprise a plurality of axially aligned cylindrical rollers.

8. The sealing apparatus as in claim 4; wherein, each of said plurality of roller elements comprise an elongated conical roller.

9. The sealing apparatus as in claim 1; wherein, said hollow tool member is provided with a generally conical configuration to promote the flow of feedstock through said at least one elongated radially aligned aperture.

10. A method for forming improved seals in boreholes and cylindrical shafts formed in host rock comprising the steps of:

a) providing the selected geologic horizon of the borehole/shaft with a cured concrete base member;

b) simultaneously introducing a feedstock into said borehole/shaft and subjecting said introduced feedstock to both compressive and shear stresses such that the borehole/shaft becomes filled with the stress-treated feedstock.

11. The method as in claim 10 further, including the step of:

c) heating said feedstock.

12. The method as in claim 10 further, including the step of:

d) adding water to said feedstock.

13. The method as in claim 10 further, including the step of:

e) adding heat and water to said feedstock.

14. The method as in claim 10, further, including the step of:

f) introducing steam into said feedstock to add both heat and water to said feedstock.

15. The method as in claim 10; wherein, said feedstock comprises at least one of the following materials: crushed rock, halite, potash, and bentonite.

* * * * *